US011536062B2

(12) United States Patent
Miyashiro et al.

(10) Patent No.: US 11,536,062 B2
(45) Date of Patent: Dec. 27, 2022

(54) VEHICLE DOOR DEVICE

(71) Applicant: AISIN CORPORATION, Aichi (JP)

(72) Inventors: Ryu Miyashiro, Kariya (JP); Kota Katahara, Kariya (JP)

(73) Assignee: AISIN CORPORATION, Kariya (JP)

( * ) Notice: Subject to any disclaimer, the term of this patent is extended or adjusted under 35 U.S.C. 154(b) by 428 days.

(21) Appl. No.: 16/732,391

(22) Filed: Jan. 2, 2020

(65) Prior Publication Data

US 2020/0224469 A1 Jul. 16, 2020

(30) Foreign Application Priority Data

Jan. 10, 2019 (JP) ..... JP2019-002362

(51) Int. Cl.

| | |
|---|---|
| ***E05C 17/30*** | (2006.01) |
| ***E05C 17/00*** | (2006.01) |
| ***E05C 17/56*** | (2006.01) |
| ***E05C 17/20*** | (2006.01) |

(52) U.S. Cl.

CPC ..... *E05C 17/003* (2013.01); *E05C 17/006* (2013.01); *E05C 17/203* (2013.01); *E05C 17/30* (2013.01); *E05C 17/56* (2013.01); *E05Y 2900/531* (2013.01)

(58) Field of Classification Search

CPC .... E05C 17/003; E05C 17/203; E05C 17/006; E05C 17/30; E05C 17/56

See application file for complete search history.

(56) References Cited

U.S. PATENT DOCUMENTS

| | | | | |
|---|---|---|---|---|
| 2009/0007489 | A1* | 1/2009 | Kern | E05C 17/30 49/31 |
| 2013/0074412 | A1* | 3/2013 | Wellborn | E05C 17/003 16/85 |
| 2014/0150581 | A1* | 6/2014 | Scheuring | B60J 5/047 74/89.38 |
| 2015/0059250 | A1* | 3/2015 | Miu | E05F 15/611 49/350 |
| 2016/0010379 | A1* | 1/2016 | Sauerwein | G05D 3/10 49/350 |
| 2017/0030132 | A1* | 2/2017 | Elie | E05F 15/70 |
| 2017/0247929 | A1* | 8/2017 | Lombrozo | E05B 81/64 |
| 2017/0328097 | A1* | 11/2017 | Gruber | E05C 17/56 |
| 2018/0155968 | A1* | 6/2018 | Miu | E05F 5/06 |
| 2018/0179788 | A1* | 6/2018 | Oxley | E05B 81/13 |
| 2018/0209195 | A1* | 7/2018 | Battlogg | F16F 9/56 |

(Continued)

FOREIGN PATENT DOCUMENTS

| | | | |
|---|---|---|---|
| DE | 10 2004 020 426 | A1 | 11/2005 |
| DE | 10 2008 041 354 | A1 | 2/2010 |
| JP | 2009-143251 | A | 7/2009 |

*Primary Examiner* — Justin B Rephann

(74) *Attorney, Agent, or Firm* — Oblon, McClelland, Maier & Neustadt, L.L.P.

(57) ABSTRACT

A vehicle door device includes: a braking control unit applying a braking force to a swing door of a vehicle by controlling an operation of a braking device; and an action position detection unit detecting an action position of the swing door. The braking control unit sets a strong opening prevention boundary on a closing direction side from a fully open position as a mechanical opening action limit of the swing door and applies a braking force to the swing door that opens on an opening direction side from the strong opening prevention boundary.

10 Claims, 6 Drawing Sheets

(56) References Cited

U.S. PATENT DOCUMENTS

| | | | | |
|---|---|---|---|---|
| 2020/0032563 | A1* | 1/2020 | Kito | E05B 81/14 |
| 2020/0149329 | A1* | 5/2020 | Miyashiro | E05B 83/36 |
| 2020/0165848 | A1* | 5/2020 | Shimizu | B60Q 9/00 |
| 2020/0300023 | A1* | 9/2020 | Sauerwein | H02K 11/33 |

* cited by examiner

VEHICLE DOOR DEVICE

CROSS REFERENCE TO RELATED APPLICATIONS

This application is based on and claims priority under 35 U.S.C. § 119 to Japanese Patent Application 2019-002362, filed on Jan. 10, 2018, the entire contents of which are incorporated herein by reference.

TECHNICAL FIELD

This disclosure relates to a vehicle door device.

BACKGROUND DISCUSSION

Known in the related art is a door device that controls an opening/closing action of a vehicular swing door by applying a braking force to the swing door. For example, Reference 1 discloses a configuration in which a braking force is applied to a swing door based on the frictional force of a rotating part of a door hinge by pressure being applied to the rotating part. In addition, the door device described in Reference 1 detects an adjacent object acting as a hindrance when the swing door is opened and calculates a non-contact limit position where the swing door does not come into contact with the adjacent object. In this example according to the related art, the action position of the swing door is represented by the opening action angle of the swing door. This example is configured such that a braking force is applied to the swing door in a case where the swing door is opened at a position close to the non-contact limit position.

In addition, the smoothness of an opening/closing action is one of the most important issues for vehicular swing doors. However, in the door device of the related art including the example described above, it cannot be said for sure that such a viewpoint is sufficiently reflected in braking control for the swing door, and thus there is still room for improvement in that regard.

Thus, a need exists for a door device which is not susceptible to the drawback mentioned above.

SUMMARY

A door device according to an aspect of this disclosure includes a braking control unit applying a braking force to a swing door of a vehicle by controlling an operation of a braking device and an action position detection unit detecting an action position of the swing door. The braking control unit sets a strong opening prevention boundary on a closing direction side from a fully open position as a mechanical opening action limit of the swing door and applies a braking force to the swing door that opens on an opening direction side from the strong opening prevention boundary.

BRIEF DESCRIPTION OF THE DRAWINGS

The foregoing and additional features and characteristics of this disclosure will become more apparent from the following detailed description considered with the reference to the accompanying drawings, wherein.

DETAILED DESCRIPTION

Hereinafter, an embodiment in which a vehicle door device is embodied will be described with reference to the drawings.

Figure 1:
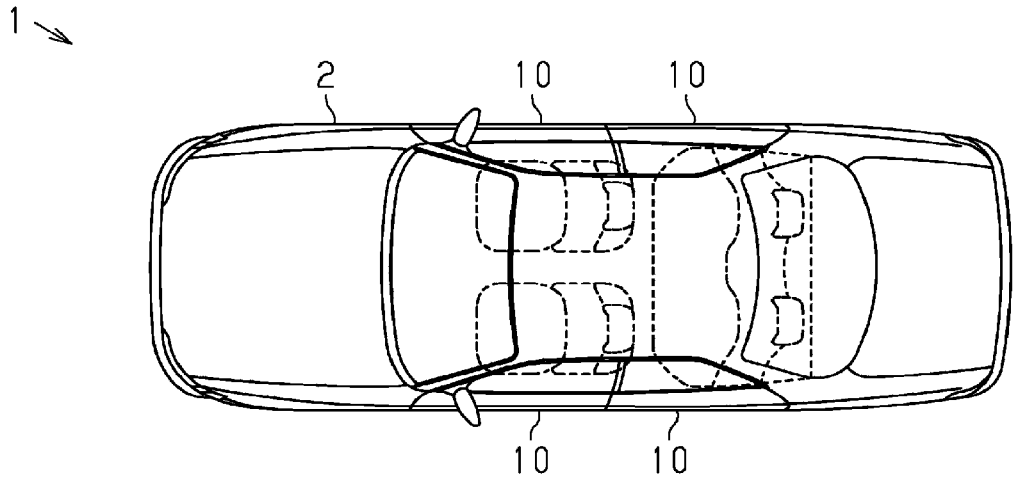
FIG. 1 is a plan view of a vehicle provided with a swing door.
Figure 2:
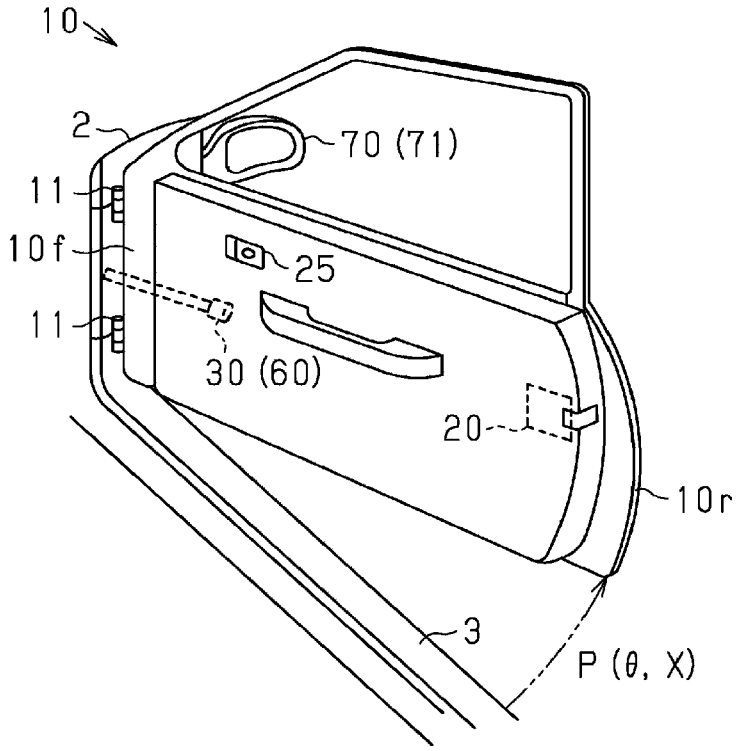
FIG. 2 is a perspective view of the swing door.

As illustrated in FIGS. 1 and 2, a vehicle 1 according to the present embodiment is provided with four swing doors 10 opening/closing door openings 3 provided in the side surfaces of a vehicle body 2. In other words, each of these swing doors 10 rotates around a hinge 11 as a fulcrum provided in a front end portion 10*f* of the swing door 10. The vehicle 1 according to the present embodiment is configured such that each of these swing doors 10 is opened/closed beside a seat provided in the interior of the vehicle 1.

Specifically, as illustrated in FIG. 2, the swing door 10 of the present embodiment is provided with a latch mechanism 20 that restrains the swing door 10 at a fully closed position by engaging with a striker (not illustrated) provided on the vehicle body 2 side. Further, the restraint on the swing door 10 of the present embodiment by the latch mechanism 20 is released by a door handle 25 being operated. As a result, the swing door 10 of the vehicle 1 of the present embodiment can be manually opened/closed.

Figure 3:
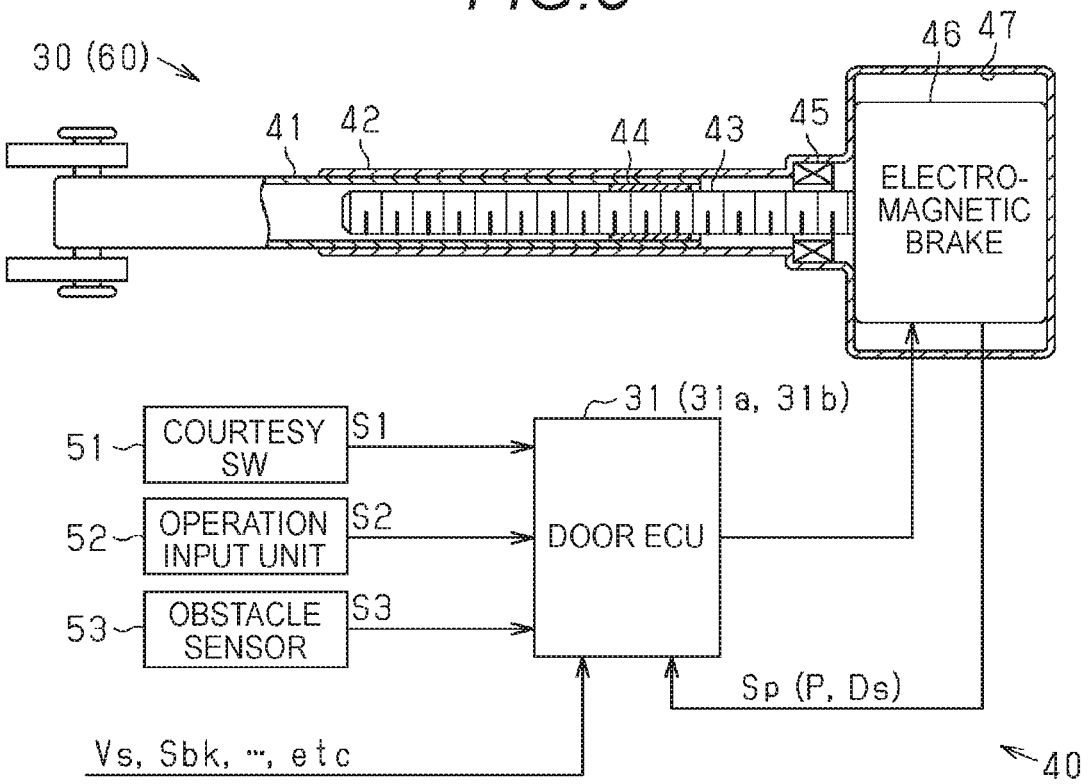
FIG. 3 is a schematic configuration diagram of a vehicle door device.

In addition, as illustrated in FIGS. 2 and 3, the swing door 10 of the present embodiment is provided with a door check device 30 having a braking function for applying a braking force to the swing door 10. Further, in the vehicle 1 of the present embodiment, the operation of the door check device 30 is controlled by a door ECU 31. As a result, a door device 40 that is capable of braking the swing door 10 and holding an action position P is formed in the vehicle 1 of the present embodiment.

More specifically, the door check device 30 of the present embodiment is provided with an inner tube 41 and an outer tube 42, one end of the inner tube 41 is rotatably connected to the vehicle body 2, and one end of the outer tube 42 is rotatably connected to the swing door 10 in a state where the inner tube 41 is inserted in the outer tube 42. In addition, the door check device 30 is provided with a spindle screw 43 that is coaxially disposed in the tubes of the inner tube 41 and the outer tube 42 extending in a substantially horizontal direction. Further, the spindle screw 43 is rotatably and pivotally supported by a bearing 45 fixed in the tube of the outer tube 42 in a state of being screwed in a spindle nut 44 fixed in the tube of the inner tube 41. The door check device 30 according to the present embodiment is provided with an electromagnetic brake 46 connected to one end of the spindle screw 43.

In other words, the door check device 30 of the present embodiment is configured such that the inner tube 41 and the outer tube 42 are axially and relatively displaced as the swing door 10 is opened/closed. Further, the door check device 30 is configured such that the spindle screw 43 rotates as a result of the relative displacement of the inner tube 41 and the outer tube 42. The door check device 30 of the present embodiment is configured such that the braking force is applied to the swing door 10 by the rotation of the spindle screw 43 being braked by the electromagnetic brake 46.

In the door check device 30 of the present embodiment, the electromagnetic brake 46 is held in a housing chamber 47 provided at one end of the outer tube 42. In addition, the door check device 30 of the present embodiment has a configuration in which one end side of the outer tube 42 is rotatably connected to the swing door 10 integrally with the electromagnetic brake 46 and via a bracket (not illustrated). The door ECU 31 of the present embodiment is configured to control the braking force applied to the swing door 10 through drive electric power supply to the electromagnetic brake 46.

More specifically, the door check device 30 of the present embodiment outputs a pulse signal Sp synchronized with the rotation of the spindle screw 43. The door ECU 31 of the present embodiment is configured to detect the action position P and an action speed Ds of the swing door 10 by counting the pulse signal Sp.

The action position P of the swing door 10 can be expressed as, for example, an opening action angle θ of the swing door 10 or an action distance X based on the fully closed or fully open position of a rear end portion 10*r* positioned at the distal end of the swing door 10 that is opened/closed (see FIG. 2).

In addition, an output signal S1 of a courtesy switch 51 provided on the swing door 10 and an operation input signal S2 indicating that an operation input unit 52 of the swing door 10 has been operated are input to the door ECU 31 of the present embodiment. Further, an output signal S3 of an obstacle sensor 53 provided in the vehicle 1 is input to the door ECU 31. The door ECU 31 of the present embodiment is configured to detect an obstacle positioned beside the swing door 10 based on the output signal S3 of the obstacle sensor 53.

In the vehicle 1 of the present embodiment, the output signal S1 of the courtesy switch 51 is turned ON by the swing door 10 being opened from the fully closed position. In addition, an inside door switch or the like is used for the operation input unit 52 of the swing door 10. An ultrasonic sensor, a millimeter wave radar sensor, or the like can be used as the obstacle sensor 53.

Further, a control signal such as a vehicle speed Vs and a brake signal Sbk is input to the door ECU 31 of the present embodiment. The door ECU 31 of the present embodiment is configured to execute braking control for the swing door 10 by means of the door check device 30 as a braking device 60 based on the vehicle information.

Figure 4:
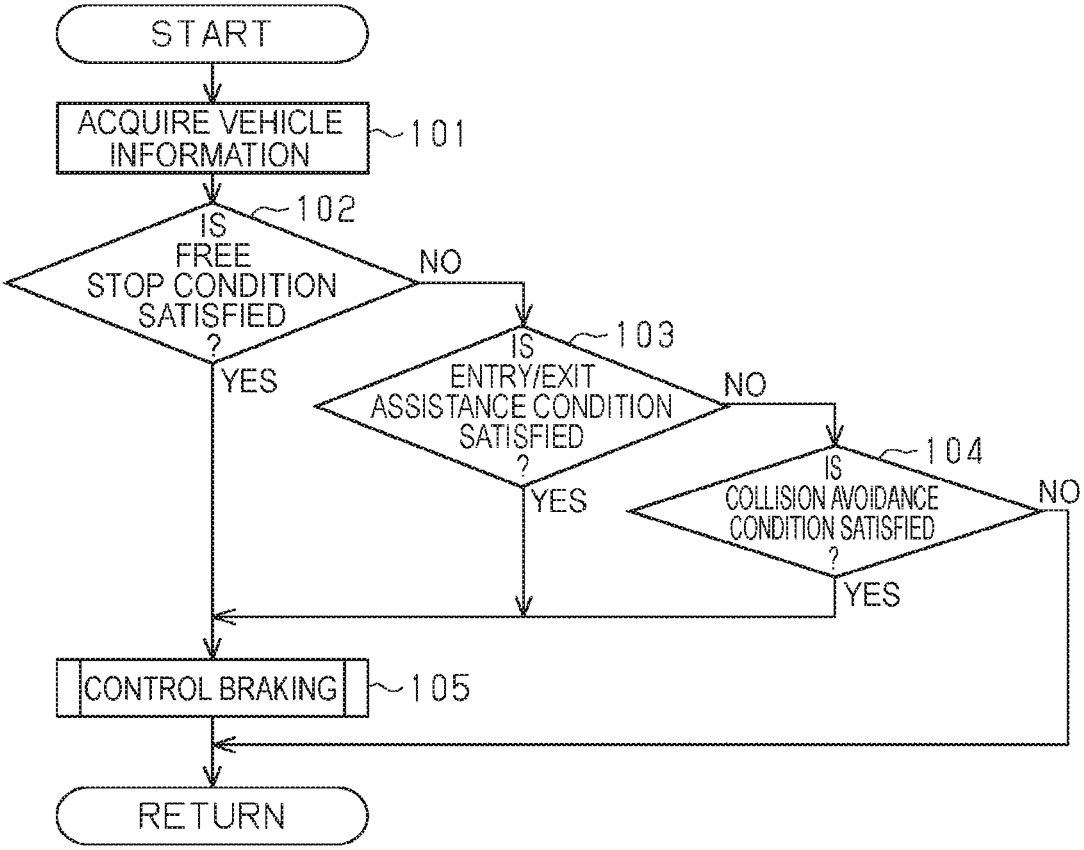
FIG. 4 is a flowchart illustrating a processing procedure with regard to a braking control execution determination.

More specifically, as illustrated in the flowchart of FIG. 4, upon acquiring the vehicle information as described above (Step 101), the door ECU 31 of the present embodiment first determines whether or not the execution condition of free stop control for holding the action position P of the swing door 10 stopped in an open state is satisfied (Step 102). Next, the door ECU 31 determines whether or not the execution condition of entry/exit assistance control for fixing the action position P of the swing door 10 and providing support during entry/exit is satisfied (Step 103). Further, the door ECU 31 determines whether or not the execution condition of collision avoidance control for applying a braking force such that the swing door 10 does not collide with an obstacle positioned beside the swing door 10 is satisfied (Step 104). In a case where any of the execution conditions is satisfied in Step 102 to Step 104 ("YES" in any of Step 102 to Step 104), the door ECU 31 of the present embodiment individually executes the braking control that corresponds to the satisfied execution condition (Step 105).

Specifically, as for the door ECU 31 of the present embodiment, detection of the swing door 10 being in the open state based on the output signal S1 of the courtesy switch 51 and the swing door 10 being in a stopped state for a predetermined time or more is the execution condition of the free stop control. In addition, in a case where the swing door 10 is in the open state, the door ECU 31 uses the operation input unit 52 being operated as the execution condition of the entry/exit assistance control. Further, the door ECU 31 of the present embodiment calculates the initiation position of the collision avoidance control based on the action speed Ds of the swing door 10. The swing door 10 being opened beyond the initiation position is used as the execution condition of the collision avoidance control.

In the door device 40 of the present embodiment, the magnitude of the braking force applied to the swing door 10 by the free stop control being executed is set to such an extent that an occupant of the vehicle 1 can manually change the action position P of the swing door 10 held based on the braking force. In addition, the braking force applied to the swing door 10 by the entry/exit assistance control being executed is set to a magnitude at which the action position P can be held in a fixed state even in a case where a vehicle occupant has used the swing door 10 as a support during entry/exit. In the collision avoidance control, the action speed Ds of the swing door 10 is quickly reduced by a large braking force being applied, and then the braking force is weakened. As a result, it is possible to prevent a sudden stop of the swing door 10 and smoothly brake the swing door 10 that is opened toward an obstacle without giving discomfort to an occupant of the vehicle 1 operating the swing door 10.

Figure 5:
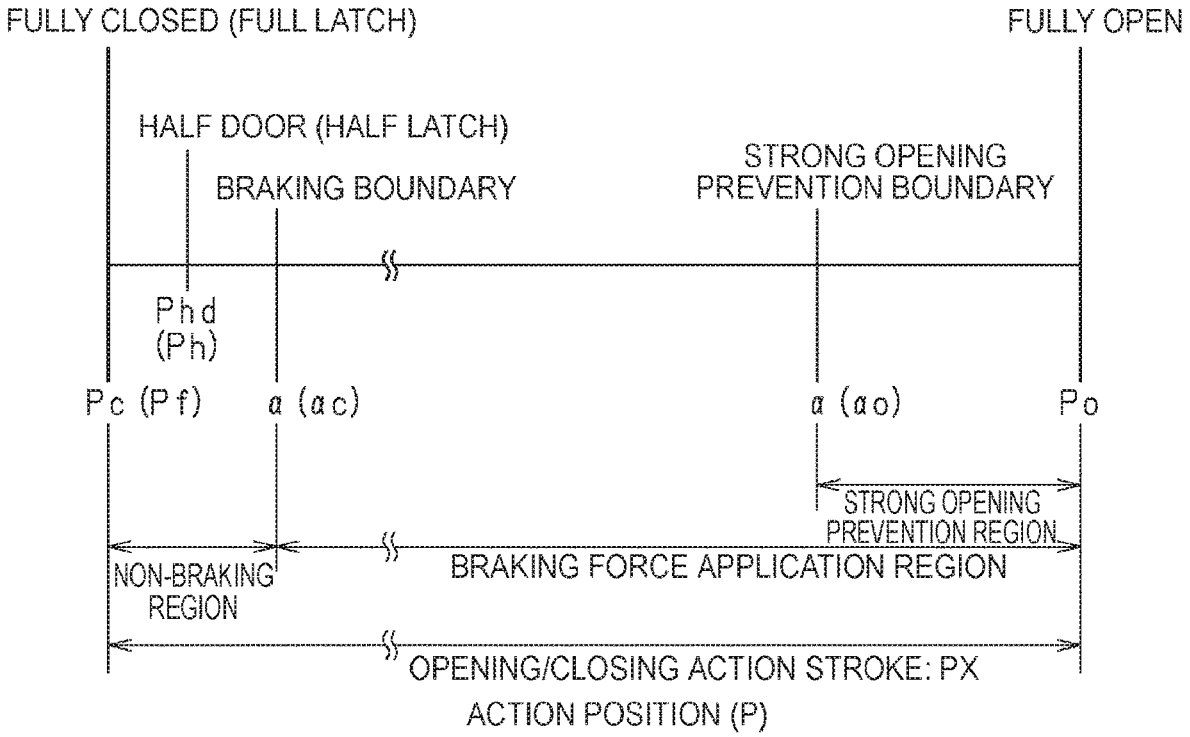
FIG. 5 is an explanatory diagram illustrating setting of a boundary position with respect to the opening/closing action stroke of the swing door and a mode of braking force application based on an action position of the swing door based on the boundary position.

In addition, as illustrated in FIG. 5, the door ECU 31 of the present embodiment sets a boundary position α in an opening/closing action stroke PX of the swing door 10 that is opened/closed between a fully closed position Pc and a fully open position Po. How to apply a braking force to the swing door 10 is determined based on whether the action position P of the swing door 10 is in an opening direction or a closing direction with the boundary position α used as a reference.

Specifically, in the swing door 10 of the present embodiment, a full latch position Pf where the swing door is restrained with respect to the vehicle body 2 based on the engagement force of the latch mechanism 20 is the fully closed position Pc of the opening/closing action stroke PX. Further, the door ECU 31 of the present embodiment sets a braking boundary αc as the boundary position α on the opening direction side in the opening/closing action stroke PX (right side in FIG. 5) from a half latch position Ph where the latch mechanism 20 generates the engagement force, that is, a half-opened door position Phd where the swing door 10 becomes a half-opened door. No braking force is applied to the swing door 10 in a case where the action position P of the swing door 10 is on the closing direction side (left side in FIG. 5) from the braking boundary αc.

Figure 6:
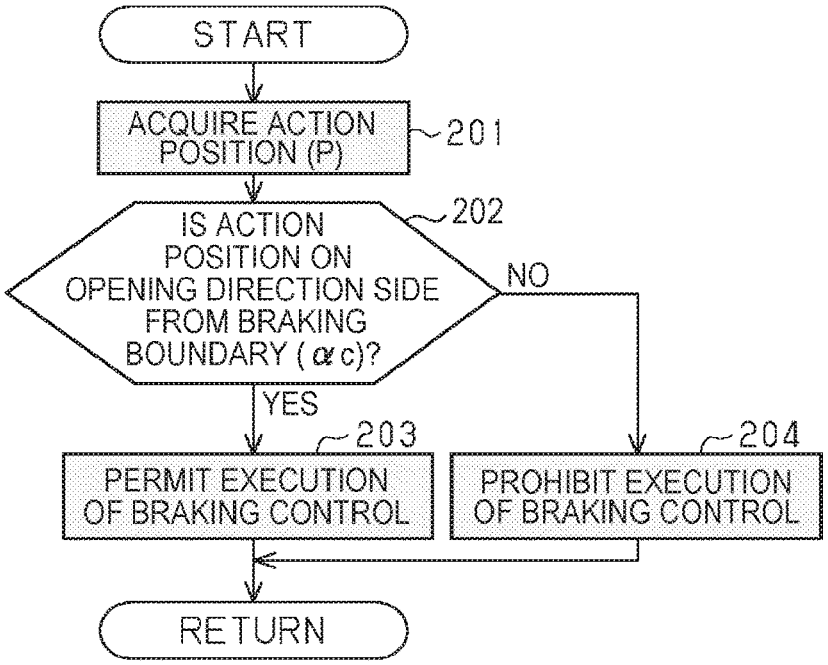
FIG. 6 is a flowchart illustrating a processing procedure with regard to a braking control necessity determination based on an action position of the swing door based on a braking boundary set in the vicinity of a fully closed position.

Specifically, as illustrated in the flowchart of FIG. 6, upon acquiring the action position P of the swing door 10 (Step 201), the door ECU 31 of the present embodiment determines whether or not the action position P is on the opening direction side from the braking boundary αc (Step 202). The execution of each braking control described above is permitted (Step 203) in a case where the action position P of the swing door 10 is on the opening direction side from the braking boundary αc (Step 202: YES). The execution of each braking control is prohibited (Step 204) in a case where the action position P is on the closing direction side from the braking boundary αc (Step 202: NO).

In other words, the opening/closing action of the swing door 10 becomes difficult by a braking force being applied to the swing door 10 in a situation in which the latch mechanism 20 generates an engagement force. In this regard, the door ECU 31 of the present embodiment sets the braking boundary αc in the vicinity of the fully closed position Pc as described above and uses the closing direction side from the braking boundary αc as a non-braking region where no braking force is applied to the swing door 10. The door device 40 of the present embodiment is configured such that a smooth action of the swing door 10 in the vicinity of the fully closed position Pc is ensured by the door ECU 31 executing each braking control described above only in a braking force application region on the opening direction side from the braking boundary αc.

In addition, as illustrated in FIG. 5, the door ECU 31 of the present embodiment sets a strong opening prevention boundary αo as the boundary position α on the closing direction side from the fully open position Po, which is the mechanical opening action limit of the swing door 10. In the door device 40 of the present embodiment, a predetermined opening action angle in the vicinity of the fully open position Po is set at the strong opening prevention boundary αo. The door ECU 31 of the present embodiment is configured to execute strong opening prevention control for preventing the swing door 10 from strongly reaching the fully open position Po by applying a braking force to the swing door 10 that is opened on the opening direction side from the strong opening prevention boundary αo.

Figure 7:
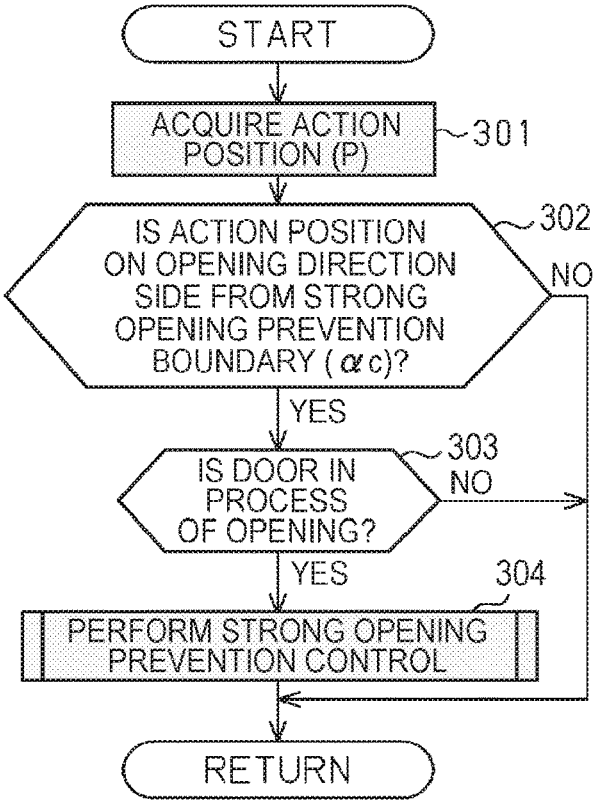
FIG. 7 is a flowchart illustrating a processing procedure with regard to a strong opening prevention control execution determination based on an action position of the swing door based on a strong opening prevention boundary set in the vicinity of a fully open position.

Specifically, as illustrated in the flowchart of FIG. 7, upon acquiring the action position P of the swing door 10 (Step 301), the door ECU 31 of the present embodiment determines whether or not the action position P is on the opening direction side from the strong opening prevention boundary αo (Step 302). Further, in a case where the door ECU 31 determines in Step 302 that the action position P of the swing door 10 is on the opening direction side from the strong opening prevention boundary αo (Step 302: YES), the door ECU 31 subsequently determines whether or not the swing door 10 is in the process of opening (Step 303). The door ECU 31 of the present embodiment is configured to execute the strong opening prevention control in a case where the door ECU 31 determines in Step 303 that the swing door 10 is in the process of opening (Step 303: YES).

In other words, the swing door 10 greatly vibrates by the swing door 10 strongly reaching the fully open position Po. As a result, the smoothness of the action is problematically impaired. In this regard, the door ECU 31 of the present embodiment sets the strong opening prevention boundary αo in the vicinity of the fully open position Po as described above. The door device 40 of the present embodiment is configured such that the action in the vicinity of the fully open position Po ensures smoothness by a braking force being applied to the swing door 10 that is opened on the opening direction side from the strong opening prevention boundary αo.

Figure 8:
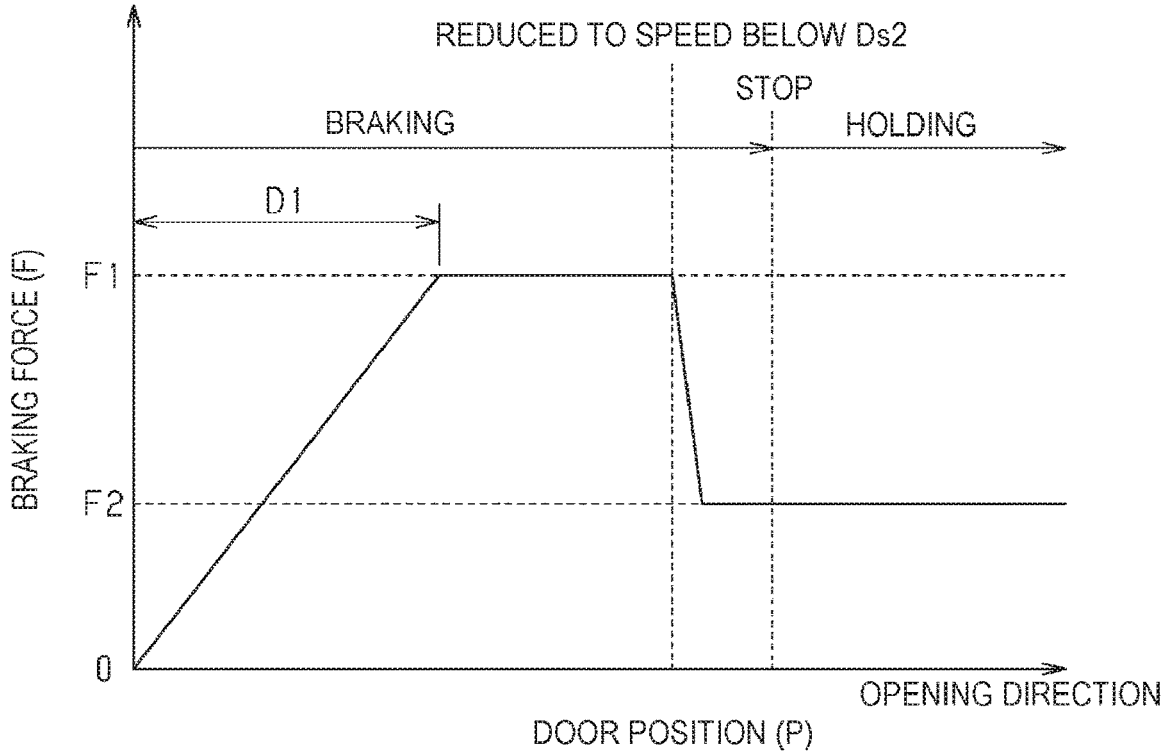
FIG. 8 is a graph illustrating a mode of strong opening prevention control.

More specifically, as illustrated in FIG. 8, the door ECU 31 of the present embodiment applies a first braking force F1 as a braking force F to the swing door 10 that is opened on the opening direction side from the strong opening prevention boundary αo. Further, the door ECU 31 subsequently changes the braking force F applied to the swing door 10 to a second braking force F2, which is lower than the first braking force F1 (F1>F2). The door ECU 31 of the present embodiment is configured to stop the swing door 10 on the closing direction side from the fully open position Po and hold the action position P of the stopped swing door 10 by maintaining the second braking force F2.

In the door device 40 of the present embodiment, the first braking force F1 is set to a magnitude corresponding to the braking force that is applied when the entry/exit assistance control is executed or the braking force that is applied to the swing door 10 for a quick reduction in the action speed Ds when the collision avoidance control is executed. The second braking force F2 is set to a magnitude corresponding to the braking force that is applied when the free stop control is executed.

In addition, the door ECU 31 of the present embodiment gradually increases the braking force F applied to the swing door 10 so as to reach the first braking force F1 with a predetermined action amount D1 after the application of the braking force F to the swing door 10 is initiated. Further, the door ECU 31 of the present embodiment changes the braking force F applied to the swing door 10 from the first braking force F1 to the second braking force F2 in a case where the action speed Ds of the swing door 10 is reduced to a speed below a predetermined low speed threshold value Ds2. At this time, the door ECU 31 of the present embodiment gradually reduces the braking force F applied to the swing door 10 so as to reach the second braking force F2 in a predetermined time.

Figure 9:
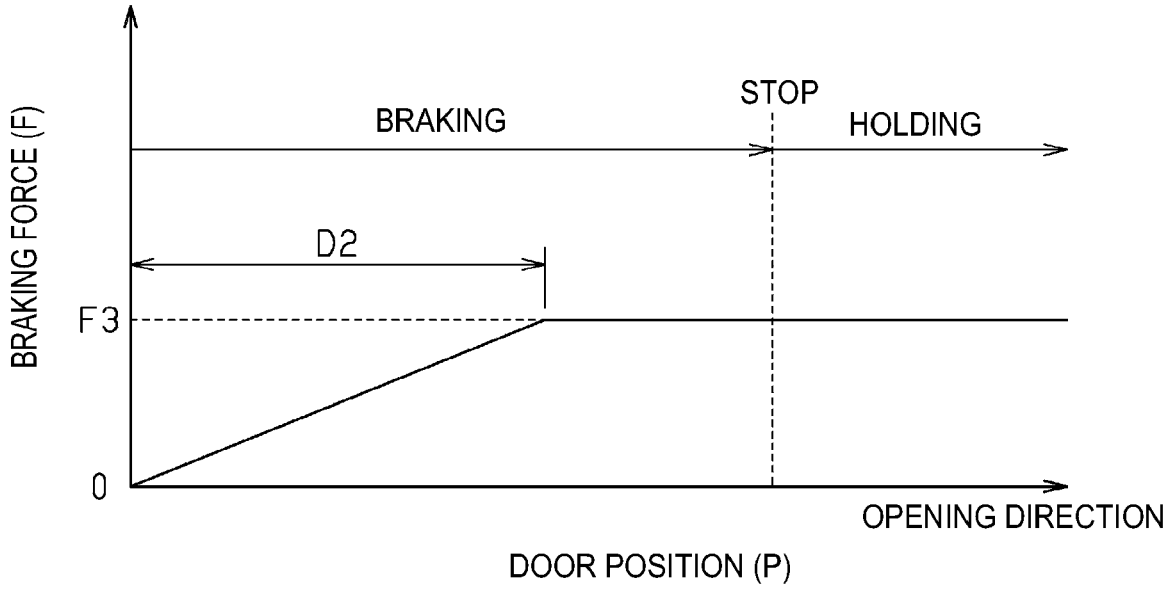
FIG. 9 is a graph illustrating a mode of the strong opening prevention control.

Further, as illustrated in FIG. 9, the door ECU 31 of the present embodiment applies a third braking force F3 lower than the first braking force F1 to the swing door 10 as the strong opening prevention control in a case where the action speed Ds of the swing door 10 that is opened on the opening direction side from the strong opening prevention boundary αo is low.

Specifically, the door ECU 31 of the present embodiment selects the third braking force F3 as the braking force F that is applied to the swing door 10 in a case where the action speed Ds of the swing door 10 is equal to or less than a predetermined braking setting threshold value Ds1. In the door device 40 of the present embodiment, the third braking force F3 is set to a magnitude corresponding to the second braking force F2. Further, the door ECU 31 gradually increases the braking force F applied to the swing door 10 so as to reach the third braking force F3 with a predetermined action amount D2 after the application of the braking force F to the swing door 10 is initiated. In this case, the door ECU 31 of the present embodiment stops the swing door 10 on the closing direction side from the fully open position Po and holds the action position P of the stopped swing door 10 by maintaining the third braking force F3.

Figure 10:
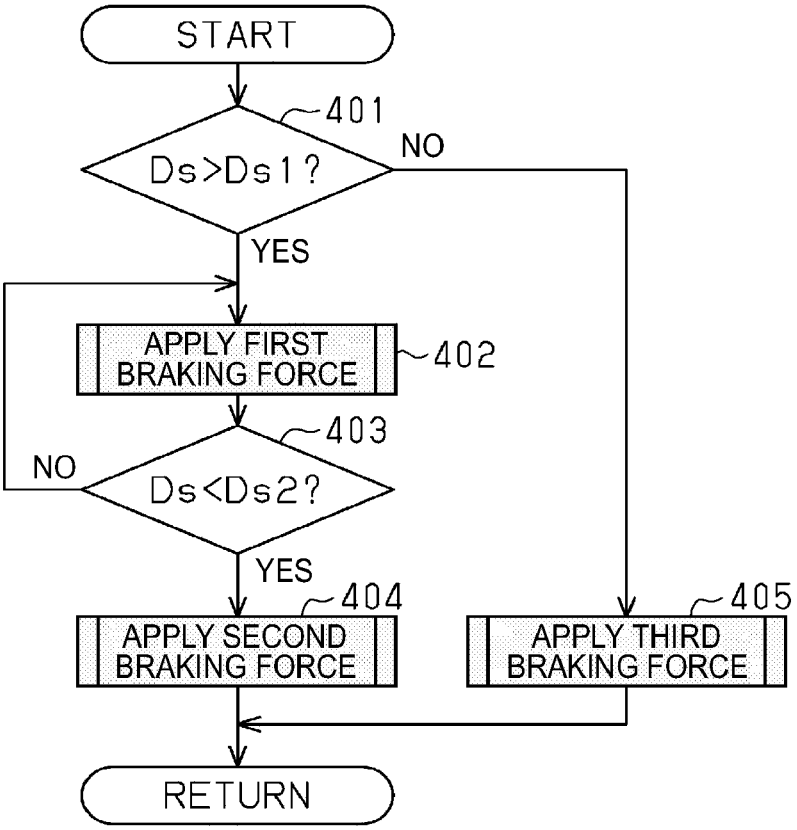
FIG. 10 is a flowchart illustrating the processing procedure of the strong opening prevention control.

In other words, as illustrated in the flowchart of FIG. 10, in a case where the door ECU 31 of the present embodiment executes the strong opening prevention control, the door ECU 31 first compares the predetermined braking setting threshold value Ds1 with the action speed Ds of the swing door 10 that is opened on the opening direction side from the strong opening prevention boundary αo (Step 401). The first braking force F1 is applied to the swing door 10 (Step 402) in a case where the action speed Ds of the swing door 10 is higher than the braking setting threshold value Ds1 in Step 401 (Ds>Ds1, Step 401: YES).

Further, the door ECU 31 compares the action speed Ds of the swing door 10 with the predetermined low speed threshold value Ds2 (Step 403). The braking force F applied to the swing door 10 is changed to the second braking force F2 (Step 404) in a case where the action speed Ds falls below the low speed threshold value Ds2 (Ds<Ds2, Step 403: YES).

The door ECU 31 of the present embodiment does not execute the processing of Step 402 to Step 404 in a case where the door ECU 31 of the present embodiment determines in Step 401 that the action speed Ds of the swing door 10 that is opened on the opening direction side from the strong opening prevention boundary αo is equal to or less than the predetermined braking setting threshold value Ds1 (Ds≤Ds1, Step 401: NO). Then, the third braking force F3 is applied to the swing door 10 by Step 405 being executed.

Figure 11:
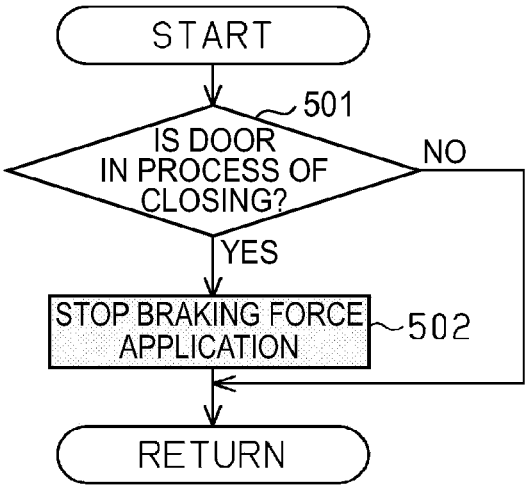
FIG. 11 is a flowchart illustrating a processing procedure for stopping braking force application during the strong opening prevention control.

In addition, as illustrated in the flowchart of FIG. 11, the door ECU 31 of the present embodiment determines whether or not the swing door 10 has been closed during the execution of the strong opening prevention control (Step 501). The door ECU 31 of the present embodiment uses the swing door 10 being closed from the stopped state or the closing action entailing a predetermined action amount as an additional determination condition for the closing action determination in Step 501. Further, in a case where the door ECU 31 of the present embodiment determines in Step 501 that the swing door 10 has been closed (Step 501: YES), the door ECU 31 stops applying the braking force to the swing door 10 (Step 502). As a result, the door device 40 of the present embodiment allows an occupant of the vehicle 1 to smoothly close the swing door 10 positioned in the vicinity of the fully open position Po.

Next, the effects of the present embodiment will be described.

(1) The door ECU 31 has a function as a braking control unit 31*a* applying a braking force to the swing door 10 of the vehicle 1 by controlling the operation of the door check device 30 serving as the braking device 60. In addition, the door ECU 31 has a function as an action position detection unit 31*b* detecting the action position P of the swing door 10. Further, the door ECU 31 sets the strong opening prevention boundary αo on the closing direction side from the fully open position Po, which is the mechanical opening action limit of the swing door 10. The door ECU 31 applies a braking force to the swing door 10 that is opened on the opening direction side from the strong opening prevention boundary αo.

With the configuration described above, it is possible to prevent the swing door 10 from strongly reaching the fully open position Po. As a result, it is possible to avoid the occurrence of a situation in which the smoothness of the action is impaired, examples of which include the swing door 10 greatly vibrating due to the impact at a time when the swing door 10 is reached the fully open position Po. As a result, a smooth action of the swing door 10 in the vicinity of the fully open position Po can be ensured.

(2) The door ECU 31 stops the swing door 10 on the closing direction side from the fully open position Po by applying a braking force to the swing door 10.

With the configuration described above, it is possible to suppress strongly reaching the fully open position Po, where vibration to impair the smoothness of the action is likely to occur. As a result, a smooth action of the swing door 10 can be ensured in a more preferable manner.

(3) The door ECU 31 holds the action position P of the swing door 10 stopped on the closing direction side from the fully open position Po by applying a braking force to the swing door 10.

In the configuration described above, it becomes even more difficult for the swing door 10 to reach the fully open position Po. As a result, a smooth action of the swing door 10 can be ensured in a more preferable manner.

(4) The door ECU 31 applies the first braking force F1 as the braking force F to the swing door 10 that is opened on the opening direction side from the strong opening prevention boundary αo. Subsequently, the door ECU 31 changes the braking force F to the second braking force F2 lower than the first braking force F1 (F1>F2).

With the configuration described above, it is possible to quickly reduce the action speed Ds of the swing door 10 by applying a large braking force. Further, it is possible to avoid a situation in which the swing door 10 suddenly stops by subsequently weakening the braking force that is applied to the swing door 10. As a result, a smooth action can be ensured.

(5) The door ECU 31 changes the braking force F from the first braking force F1 to the second braking force F2 in a case where the action speed Ds of the swing door 10 is reduced to a speed below the predetermined low speed threshold value Ds2 (Ds<Ds2). As a result, a quick deceleration of the swing door 10 can be ensured.

(6) In a case where the action speed Ds of the swing door 10 that is opened on the opening direction side from the strong opening prevention boundary αo is equal to or less than the predetermined braking setting threshold value Ds1, the door ECU 31 applies the third braking force F3 lower than the first braking force F1 as the braking force F (F1>F3).

With the configuration described above, it is possible to avoid a situation in which the swing door 10 suddenly stops by applying a braking force to the swing door 10. As a result, a smooth action can be ensured.

(7) The door ECU 31 gradually changes the braking force F in a case where the door ECU 31 increases or decreases the braking force F.

With the configuration described above, it is possible to increase or decrease the braking force that is applied to the swing door 10 without giving discomfort to an occupant of the vehicle 1 operating the swing door 10. As a result, a smooth action of the swing door 10 during braking can be ensured.

(8) In a case where the door ECU 31 detects a closing action of the swing door 10 with regard to the swing door 10 to which a braking force is applied as a result of an opening action on the opening direction side from the strong opening prevention boundary αo, the door ECU 31 stops applying the braking force. As a result, an occupant of the vehicle 1 operating the swing door 10 can smoothly close the swing door 10.

(9) In the swing door 10, the full latch position Pf where the swing door 10 is restrained with respect to the vehicle body 2 based on the engagement force of the latch mechanism 20 provided in the swing door 10 is the fully closed position Pc. In addition, the door ECU 31 sets the braking boundary αc on the opening direction side from the half latch position Ph where the latch mechanism 20 generates the engagement force. The door ECU 31 applies no braking force to the swing door 10 in a case where the action position P of the swing door 10 is on the closing direction side from the braking boundary αc.

With the configuration described above, it is possible to prevent braking force application to the swing door 10 in a situation in which the latch mechanism 20 generates an engagement force. As a result, a smooth action of the swing door 10 in the vicinity of the fully closed position Pc can be ensured.

The embodiment described above can be implemented with the following modifications. The embodiment described above and the following modification examples can be implemented in combination with each other within a technically consistent scope.

Although the braking boundary αc is set on the opening direction side from the half latch position Ph in the embodiment described above, the setting position may be changed further to the opening direction side.

Figure 12A:
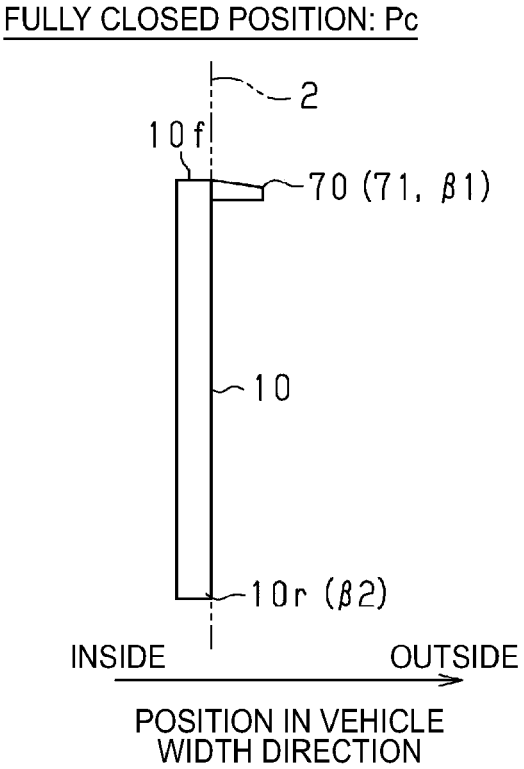
FIGS. 12A and 12B are explanatory diagrams illustrating another example of braking boundary setting.
Figure 12B:
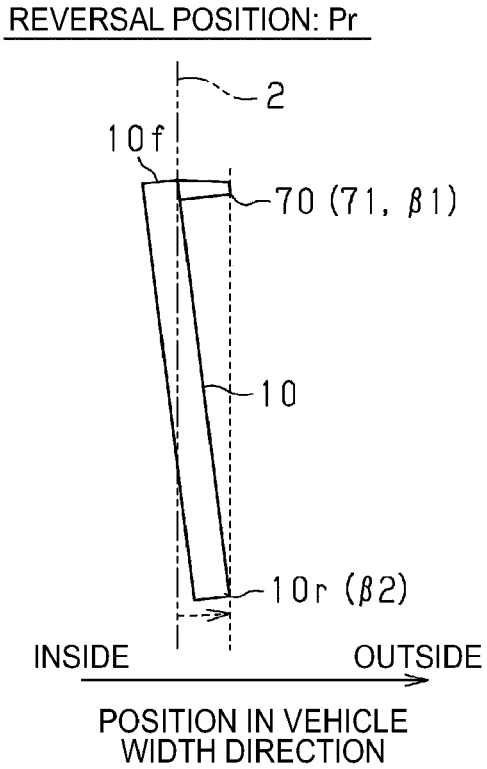

As in the example illustrated in FIGS. 12A and 12B, in many cases, the swing door 10 of the vehicle 1 is opened by the rear end portion 10*r* side being swung outward in the vehicle width direction (to the right side in FIGS. 12A and 12B) with the front end portion 10*f* side connected to the vehicle body 2 via the hinge 11 used as a fulcrum. Accordingly, in the case of the swing door 10 in which the front end portion 10*f* is provided with a door mirror 71 serving as a rear view member 70, a reversal position Pr is present where a distal end position β1 of the door mirror 71 projecting outward in the vehicle width direction from the front end portion 10*f* of the swing door 10 and a rear end position β2 of the swing door 10 are reversed in the vehicle width direction based on the opening/closing action of the swing door 10. In such a case, the reversal position Pr may be set at the braking boundary αc.

In other words, it is conceivable that a situation in which an occupant operating the swing door 10 intentionally holds the action position P of the swing door 10 is unlikely to occur in such a region with a small door opening degree. In a state where the distal end position β1 of the door mirror 71 projects outward in the vehicle width direction beyond the rear end position β2 of the swing door 10, it is conceivable that the swing door 10 is unlikely to collide with an obstacle as a result of the opening action of the swing door 10. Accordingly, with the configuration described above, it is possible to apply a braking force in a more appropriate manner and ensure a smooth action of the swing door 10.

Application may be performed on the swing door 10 that is provided with the rear view member 70 which is similar, examples of which include the swing door 10 that is provided with, for example, a rear view camera projecting outward in the vehicle width direction from the front end portion 10*f* of the swing door 10. Similar effects can be obtained from such a configuration.

In the embodiment described above, a braking force is applied to the swing door 10 that is opened on the opening direction side from the strong opening prevention boundary αo. As a result, the swing door 10 is stopped on the closing direction side from the fully open position Po and the action position P of the stopped swing door 10 is held. However, the embodiment disclosed here is not limited thereto and the action position P of the stopped swing door 10 may not necessarily be held. In addition, the swing door 10 may not necessarily be stopped on the closing direction side from the fully open position Po.

In the embodiment described above, the first braking force F1 is applied as the braking force F to the swing door 10 that is opened on the opening direction side from the strong opening prevention boundary αo, and then the braking force F is changed to the second braking force F2 lower than the first braking force F1. In a case where the action speed Ds of the swing door 10 that is opened on the opening direction side from the strong opening prevention boundary αo is equal to or less than the predetermined braking setting threshold value Ds1, the third braking force F3 lower than the first braking force F1 is applied as the braking force F. However, the embodiment disclosed here is not limited thereto. For example, the braking force F that corresponds to the action speed Ds of the swing door 10 opened on the opening direction side from the strong opening prevention boundary αo may be determined by a predetermined arithmetic expression, map calculation, or the like being used. In another configuration, the braking force F applied to the swing door 10 may not be reduced midway.

Although the braking force F is changed from the first braking force F1 to the second braking force F2 in a case where the action speed Ds of the swing door 10 is reduced to a speed below the predetermined low speed threshold value Ds2 (Ds<Ds2) in the embodiment described above, the timing at which the braking force F is reduced may be changed to any timing such as the elapse of a predetermined time.

In the embodiment described above, the braking force F applied to the swing door 10 is gradually increased such that the first braking force F1 is reached with the predetermined action amount D1 after the application of the braking force F is initiated. In addition, in a case where the braking force F is changed from the first braking force F1 to the second braking force F2, the braking force F applied to the swing door 10 is gradually decreased such that the second braking force F2 is reached in a predetermined time. In addition, the braking force F applied to the swing door 10 is gradually increased such that the third braking force F3 is reached with the predetermined action amount D2 after the application of the braking force F is initiated. However, the embodiment disclosed here is not limited thereto and the mode of gradual change control in a case where the braking force F is increased or decreased as described above may be changed in any manner. In other words, the gradual change may be performed on an action amount basis or on a time basis. In another configuration, the gradual change may be performed in a stepwise manner or a target braking force may be applied to the swing door 10 without such gradual change control being performed.

In the embodiment described above, the door ECU 31 stops applying a braking force in a case where the door ECU 31 detects a closing action of the swing door 10 with regard to the swing door 10 to which the braking force is applied as a result of an opening action on the opening direction side from the strong opening prevention boundary αo. Regarding the closing action determination, the door ECU 31 uses the swing door 10 being closed from the stopped state or the closing action entailing a predetermined action amount as an additional determination condition. However, the embodiment disclosed here is not limited thereto and these additional determination conditions may be changed in any manner. In another configuration, such an additional determination condition may not be provided.

Next, the technical idea that can be grasped from the embodiment and the modification examples will be described.

A door device according to an aspect of this disclosure includes a braking control unit applying a braking force to a swing door of a vehicle by controlling an operation of a braking device and an action position detection unit detecting an action position of the swing door. The braking control unit sets a strong opening prevention boundary on a closing direction side from a fully open position as a mechanical opening action limit of the swing door and applies a braking force to the swing door that opens on an opening direction side from the strong opening prevention boundary.

With the configuration described above, it is possible to prevent the swing door from strongly reaching the fully open position. As a result, it is possible to avoid the occurrence of a situation in which the smoothness of the action is impaired, examples of which include the swing door greatly vibrating due to the impact at a time when the swing door is reached the fully open position. As a result, a smooth action of the swing door in the vicinity of the fully open position can be ensured.

In the door device according to the aspect of this disclosure, it is preferable that the braking control unit stops the swing door on the closing direction side from the fully open position by applying the braking force.

With the configuration described above, it is possible to suppress reaching the fully open position, where vibration to impair the smoothness of the action is likely to occur. As a result, a smooth action of the swing door can be ensured in a more preferable manner.

In the door device according to the aspect of this disclosure, it is preferable that the braking control unit holds an action position of the stopped swing door by applying the braking force.

In the configuration described above, it becomes even more difficult for the swing door to reach the fully open position. As a result, a smooth action of the swing door can be ensured in a more preferable manner.

In the door device according to the aspect of this disclosure, it is preferable that the braking control unit applies a first braking force as the braking force to the swing door that opens on an opening direction side from the strong opening prevention boundary and then changes the braking force to a second braking force lower than the first braking force.

With the configuration described above, it is possible to quickly reduce the action speed of the swing door by applying a large braking force. Further, it is possible to avoid a situation in which the swing door suddenly stops by subsequently weakening the braking force that is applied to the swing door. As a result, a smooth action can be ensured.

In the door device according to the aspect of this disclosure, it is preferable that the braking control unit changes the braking force from the first braking force to the second braking force in a case where an action speed of the swing door is reduced to a speed below a predetermined low speed threshold value.

With the configuration described above, a quick deceleration of the swing door can be ensured.

In the door device according to the aspect of this disclosure, it is preferable that the braking control unit applies a third braking force lower than the first braking force as the braking force in a case where an action speed of the swing door that opens on an opening direction side from the strong opening prevention boundary is equal to or less than a predetermined braking setting threshold value.

With the configuration described above, it is possible to avoid a situation in which the swing door suddenly stops by applying a braking force to the swing door. As a result, a smooth action can be ensured.

In the door device according to the aspect of this disclosure, the braking control unit gradually changes the braking force in a case where the braking force is increased or decreased.

With the configuration described above, it is possible to increase or decrease the braking force that is applied to the swing door without giving discomfort to an occupant of the vehicle operating the swing door. As a result, a smooth action of the swing door during braking can be ensured.

In the door device according to the aspect of this disclosure, it is preferable that the braking control unit stops applying the braking force in a case where a closing action of the swing door is detected.

With the configuration described above, an occupant of the vehicle operating the swing door can smoothly close the swing door.

In the door device according to the aspect of this disclosure, it is preferable that a full latch position where the swing door is restrained with respect to a vehicle body based on an engagement force of a latch mechanism provided in the swing door serves as a fully closed position of the swing door and the braking control unit sets a braking boundary on an opening direction side from a half latch position where the latch mechanism generates the engagement force and does not apply the braking force in a case where an action position of the swing door is on the closing direction side from the braking boundary.

With the configuration described above, it is possible to prevent braking force application to the swing door in a situation in which the latch mechanism generates an engagement force. As a result, a smooth action of the swing door in the vicinity of the fully closed position can be ensured.

In the door device according to the aspect of this disclosure, it is preferable that the braking control unit sets the braking boundary on the opening direction side from an action position of the swing door where a distal end position of a rear view member provided in a front end portion of the swing door and a rear end position of the swing door are reversed in a vehicle width direction.

In other words, it is conceivable that a situation in which an occupant operating the swing door intentionally holds the action position of the swing door is unlikely to occur in such a region with a small door opening degree. In a state where the distal end of the rear view member projects outward in the vehicle width direction beyond the rear end of the swing door, it is conceivable that the swing door is unlikely to collide with an obstacle as a result of the opening action of the swing door. Accordingly, with the configuration described above, it is possible to apply a braking force in a more appropriate manner and ensure a smooth action of the swing door.

According to the aspect of this disclosure, it is possible to ensure a smooth action of the swing door.

A vehicle door device according to another aspect of this disclosure includes a braking control unit applying a braking force to a swing door of a vehicle by controlling an operation of a braking device and an action position detection unit detecting an action position of the swing door, in which a full latch position where the swing door is restrained with respect to a vehicle body based on an engagement force of a latch mechanism provided in the swing door serves as a fully closed position and the braking control unit sets a braking boundary on an opening direction side from a half latch position where the latch mechanism generates the engagement force and does not apply the braking force in a case where an action position of the swing door is on the closing direction side from the braking boundary.

A vehicle door device according to another aspect of this disclosure includes a braking control unit applying a braking force to a swing door of a vehicle by controlling an operation of a braking device and an action position detection unit detecting an action position of the swing door, in which the braking control unit sets a boundary position in an opening/closing action stroke of the swing door and determines how to apply a braking force to the swing door based on whether the action position is in an opening direction or a closing direction by using the boundary position as a reference.

With the configuration described above, it is possible to apply a braking force in an appropriate manner in accordance with the action position of the swing door. As a result, it is possible to ensure a smooth swing door action.

The principles, preferred embodiment and mode of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

What is claimed is:

1. A vehicle door device comprising:

a braking control unit applying a braking force to a swing door of a vehicle by controlling an operation of a braking device; and an action position detection unit detecting an action position of the swing door, wherein the swing door is opened/closed between a fully closed position and a fully open position in an opening/closing action stroke of the swing door, the swing door moving in an opening direction from the fully closed position to the fully open position, and moving in a closing direction from the fully open position to the fully closed position, the braking control unit sets a strong opening prevention boundary in the closing direction from the fully open position as a mechanical opening action limit of the swing door and applies a braking force to the swing door that opens in the opening direction from the strong opening prevention boundary, a full latch position where the swing door is restrained with respect to a vehicle body based on an engagement force of a latch mechanism provided in the swing door serves as the fully closed position of the swing door, the braking control unit sets a braking boundary in the opening direction from a half latch position where the latch mechanism generates the engagement force and does not apply the braking force when an action position of the swing door is between the braking boundary and the fully closed position, and the braking control unit sets the braking boundary in the opening direction from an action position of the swing door where a distal end position of a rear view member provided in a front end portion of the swing door and a rear end position of the swing door are reversed in a vehicle width direction.

2. The vehicle door device according to claim 1, wherein the braking control unit stops the swing door when the swing door moves from the fully open position in the closing direction by applying the braking force.

3. The vehicle door device according to claim 2, wherein the braking control unit holds an action position of the stopped swing door by applying the braking force.

4. The vehicle door device according to claim 1, wherein the braking control unit applies a first braking force as the braking force to the swing door that opens in the opening direction from the strong opening prevention boundary and then changes the braking force to a second braking force lower than the first braking force.

5. The vehicle door device according to claim 4, wherein the braking control unit changes the braking force from the first braking force to the second braking force in a case where an action speed of the swing door is reduced to a speed below a predetermined low speed threshold value.

6. The vehicle door device according to claim 4, wherein the braking control unit applies a third braking force lower than the first braking force as the braking force in a case where an action speed of the swing door that opens in the opening direction from the strong opening prevention boundary is equal to or less than a predetermined braking setting threshold value.

7. The vehicle door device according to claim 4, wherein the braking control unit gradually changes the braking force in a case where the braking force is increased or decreased.

8. The vehicle door device according to claim 1, wherein the braking control unit stops applying the braking force in a case where a closing action of the swing door is detected.

9. A vehicle door device comprising:

a braking control unit applying a braking force to a swing door of a vehicle by controlling an operation of a braking device; and an action position detection unit detecting an action position of the swing door, wherein the swing door is opened/closed between a fully closed position and a fully open position in an opening/closing action stroke of the swing door, the swing door moving in an opening direction from the fully closed position to the fully open position, and moving in a closing direction from the fully open position to the fully closed position, a full latch position where the swing door is restrained with respect to a vehicle body based on an engagement force of a latch mechanism provided in the swing door serves as the fully closed position, the braking control unit sets a braking boundary in the opening direction from a half latch position where the latch mechanism generates the engagement force and does not apply the braking force when an action position of the swing door is between the braking boundary and the fully closed position, and the braking control unit sets the braking boundary on the opening direction from an action position of the swing door where a distal end position of a rear view member provided in a front end portion of the swing door and a rear end position of the swing door are reversed in a vehicle width direction.

10. A vehicle door device comprising:

a braking control unit applying a braking force to a swing door of a vehicle by controlling an operation of a braking device; and an action position detection unit detecting an action position of the swing door, wherein the swing door is opened/closed between a fully closed position and a fully open position in an opening/closing action stroke of the swing door, the swing door moving in an opening direction from the fully closed position to the fully open position, and moving in a closing direction from the fully open position to the fully closed position, the braking control unit sets a boundary position in the opening/closing action stroke of the swing door and determines how to apply a braking force to the swing door based on a location of the action position using the boundary position as a reference, a full latch position where the swing door is restrained with respect to a vehicle body based on an engagement force of a latch mechanism provided in the swing door serves as the fully closed position of the swing door, the braking control unit sets a braking boundary in the opening direction from a half latch position where the latch mechanism generates the engagement force and does not apply the braking force when an action position of the swing door is between the braking boundary and the fully closed position, and the braking control unit sets the braking boundary in the opening direction from an action position of the swing door where a distal end position of a rear view member provided in a front end portion of the swing door and a rear end position of the swing door are reversed in a vehicle width direction.

* * * * *